US005527095A

United States Patent [19]

Marshall et al.

[11] Patent Number: 5,527,095

[45] **Date of Patent: * Jun. 18, 1996**

[54] PAWL AND RATCHET ASSEMBLY

[75] Inventors: Richard E. Marshall, Monroe; Larry P. LaPointe, Temperance; Jonathan R. Saul, LaSalle; Karl J. Komorowski, Petersburg, all of Mich.

[73] Assignee: La-Z-Boy Chair Company, Monroe, Mich.

[ * ] Notice: The term of this patent shall not extend beyond the expiration date of Pat. No. 5,328,235.

[21] Appl. No.: 322,789

[22] Filed: Oct. 13, 1994

[51] Int. Cl.[6] ..... A47C 3/02; A47D 13/10

[52] U.S. Cl. ..... 297/270.1; 297/83; 297/84; 297/85; 297/258.1; 297/463.1; 297/DIG. 7

[58] Field of Search ..... 297/DIG. 7, 83, 297/84, 85, 270, 258, 463.1

[56] References Cited

U.S. PATENT DOCUMENTS 3,096,121 7/1963 Knabusch et al. .

4,179,157 12/1979 Shoemaker et al. .

5,328,235 7/1994 Saul et al. ..... 297/270

*Primary Examiner*—Peter M. Cuomo

*Assistant Examiner*—Rodney B. White

*Attorney, Agent, or Firm*—Harness, Dickey & Pierce

[57] ABSTRACT

An improved latching mechanism for a rocking-type chair selectively permits or inhibits rocking motion of the chair frame relative to the base upon actuation. The improved latching mechanism includes a pawl and ratchet assembly having a spring-biased pawl member coupled to the chair base which is operable to lockingly engage a tooth ratchet sector disposed on the chair frame for positioning the chair frame in rearwardly tilted positions and a release assembly including a rigid release link that pulls the spring-biased pawl member towards a released position by an actuation member. The actuation member includes a swing link and a trip link operably coupled to a drive rod assembly for positioning the rigid release link while preventing the release member from exerting any axial loading on the pawl member when the pawl member is in locked engagement with the ratchet teeth.

14 Claims, 5 Drawing Sheets

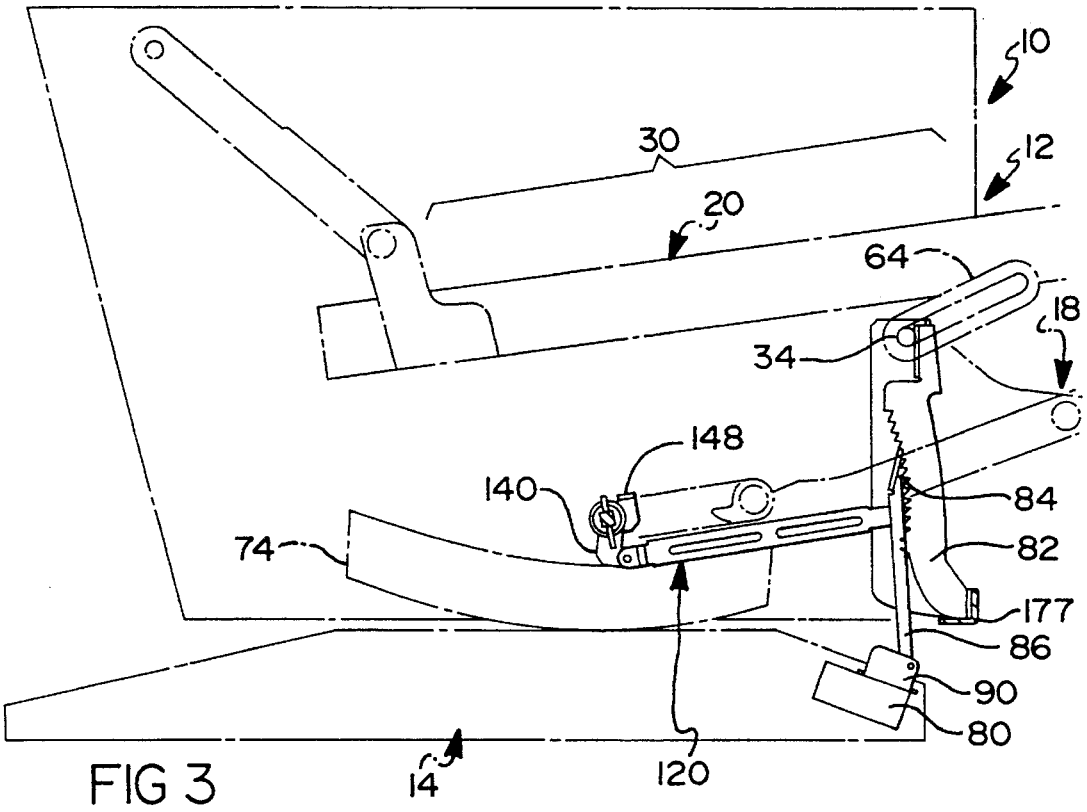
FIG 3
FIG 4
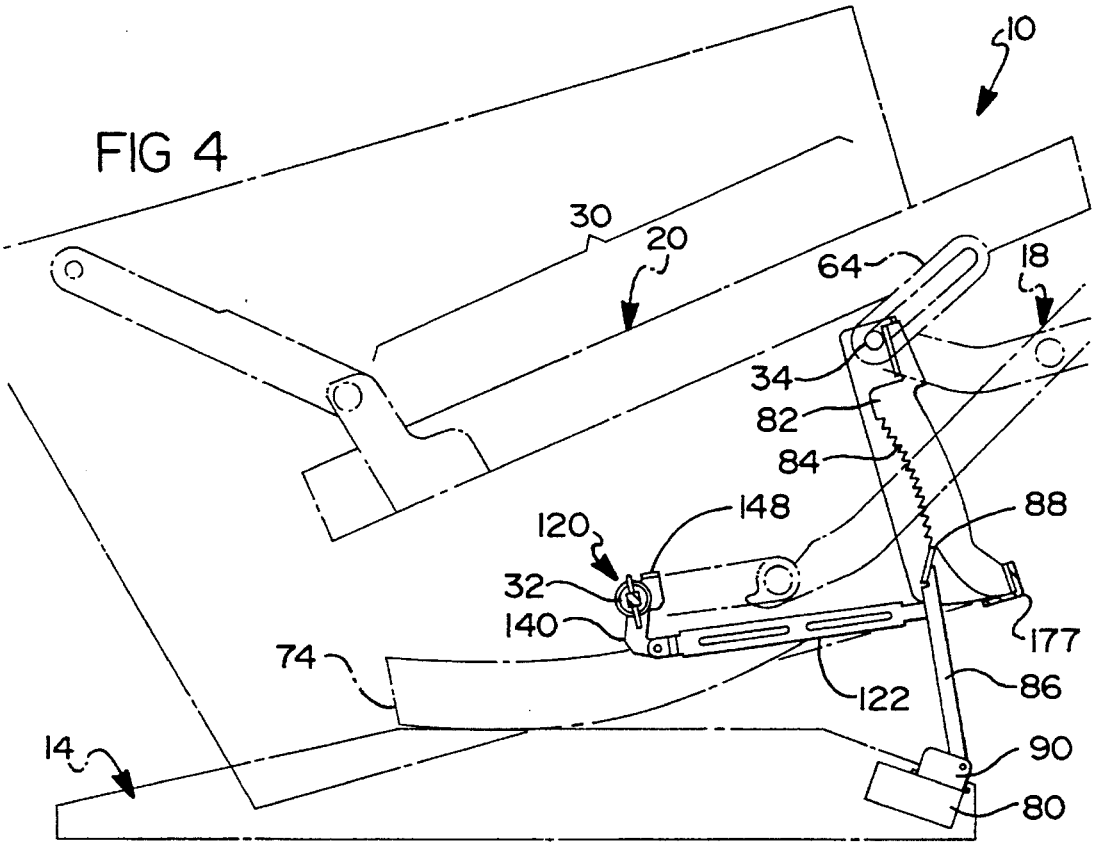

86
32
33
148
154
152
133
150
140
146
144
141
142
132
130
134
120
124
122
126
128
144'
134'
122'
103
92
96
99
110
98
108
102
100
104
105
106
112
94
90
114
115
116
117
118
91
93
84
82
34
192
196
190
200
198
194
186
177
178
180
184
182

FIG 6
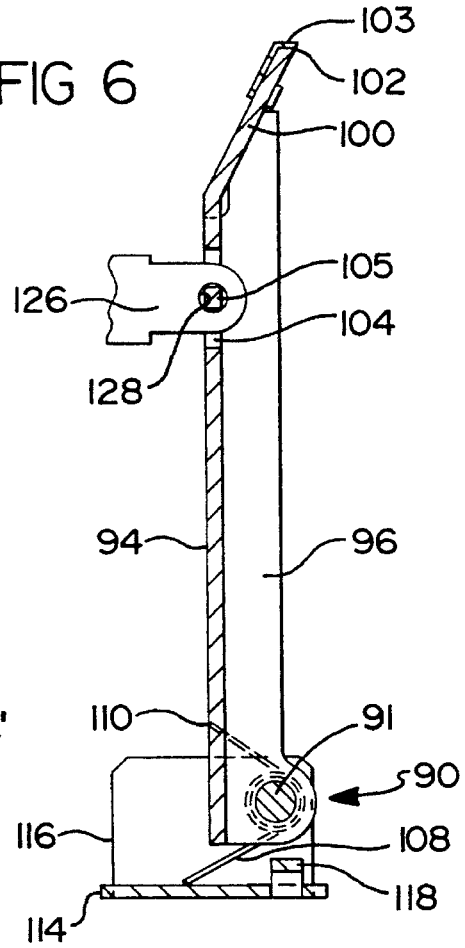
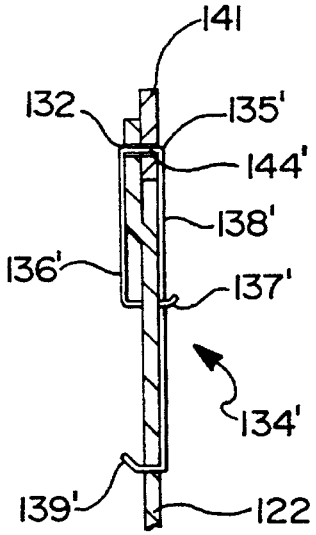
FIG 7A
FIG 7
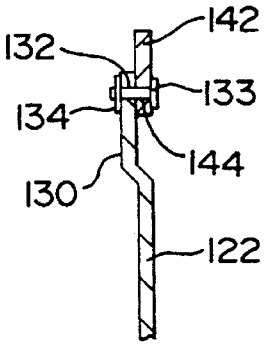
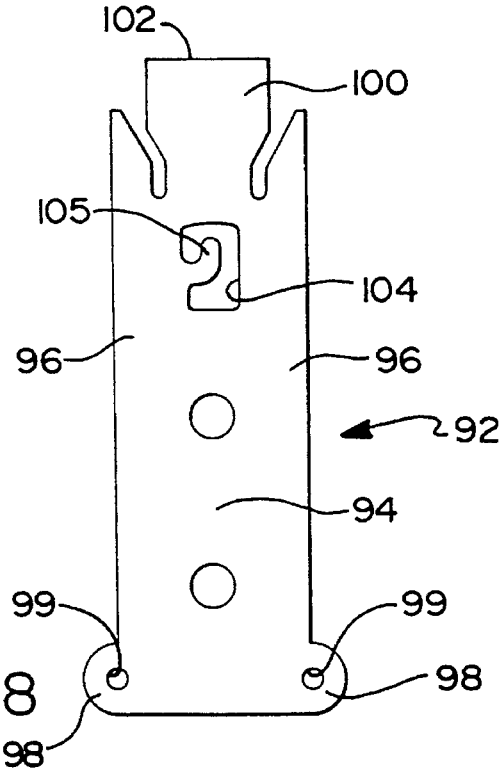
FIG 8

PAWL AND RATCHET ASSEMBLY

BACKGROUND OF THE INVENTION

The present invention relates generally to rocking chairs and, more particularly, to a rocking chair having an improved latching mechanism operable for releasably retaining the chair in a rearwardly "tilted" position.

Most rocking chairs typically include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism for permitting the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly.

As an additional comfort feature, a latching mechanism may also be provided for releasably retaining the chair frame in a rearwardly rocked or "tilted" position on the base assembly following extension of the leg rest assembly towards its extended position. In this manner, normal "rocking" action of the rocking chair is inhibited until the leg rest assembly is returned to its normally "stowed" position. Applicant's above-mentioned U.S. patents each disclose the use of a "one-way" pawl and ratchet type latching mechanism having a pawl member supported for pivotable movement from the base assembly and a toothed ratchet sector fixed to the chair frame. An elongated U-shaped spring link is used to couple the pawl member to a drive link fixed to the drive rod. Movement of the pawl member between positions of engagement and disengagement with the toothed sector is caused in response to movement of the leg rest assembly between its extended and retracted positions, respectively. More particularly, when the handle is slightly rotated for partially extending the leg rest assembly, concurrent rotation of the drive rod and the drive link causes the spring link to forcibly pivot the pawl member toward the ratchet sector until its locking tip is positioned in locked engagement with the teeth of the ratchet sector. Thereafter, continued rotation of the drive rod and drive link for completely extending the leg rest assembly causes "elastic" flexure of the elongated spring link for applying a compressive force on the pawl member. However, the magnitude of the compressive force exerted by flexure of the spring link can vary since the displacement between the drive rod and sequential ratchet points on the ratchet sector vary in response to rearward tilting movement of the chair frame. Therefore, the flexure of the elongated spring link must be sufficient to ensure that the compressive force exerted on the pawl member is sufficient to maintain locked engagement between the pawl member and the teeth of the ratchet sector throughout the entire range of rearward "tilting" movement of the chair frame.

While such conventional latching mechanisms have generally performed satisfactorily, they are inherently noisy due to the spring link exerting a large compressive force on the locking tip of the pawl member as it "ratchets" over the teeth of the ratchet sector upon rearward tilting movement of the chair frame. In addition, the cyclical flexural requirements of the spring link may lead to premature fatigue failure which could possibly cause unintentional release of the chair frame from its rearwardly tilted position.

SUMMARY OF THE INVENTION

In accordance with the principle of the present invention, an improved latching mechanism is disclosed which is designed to overcome the disadvantages associated with conventional latching mechanisms used in rocking chairs. Therefore, a primary object of the present invention is to provide an improved pawl and ratchet latching mechanism which is designed to substantially minimize the "ratcheting" noise commonly associated with its operation.

It is an additional object of the present invention to provide an improved pawl and ratchet latching mechanism having a spring-biased pawl assembly which is designed to exert a controlled biasing force on the pawl member. In accordance with one embodiment, the spring-biased pawl assembly includes a torsion spring that is arranged to normally bias the pawl member toward a position of engagement with the ratchet sector. The torsion spring effectively relocates and reduces the engagement force between the pawl member and the ratchet sector in a manner facilitating a significant noise reduction.

Yet another object of the present invention is to provide an improved pawl and ratchet latching mechanism having a unique actuation arrangement operable for transforming rotation of the drive rod into pivotable movement of the pawl member. The unique actuation arrangement includes a "non-loaded" release link that is used solely for "pulling" the locking tip of the pawl member out of engagement with the teeth of the ratchet sector. In this manner, the release link is not required to exert cyclical compressive loading on the pawl member which significantly improves the overall service life of the improved latching mechanism.

As a related object, the unique actuation arrangement is used in conjunction with the drive mechanism for facilitating universal application of the improved latching mechanism into various different rocking chair and base assembly combinations.

It is still another object of the present invention to provide an improved pawl and ratchet latching mechanism wherein the "non-loaded" release link can be easily assembled and/or replaced in the field.

A further object of the present invention is to provide a pawl assembly that can be easily manufactured in a single stamping process.

In accordance with one embodiment of the present invention, an exemplary rocking chair is disclosed having a drive rod suspended from a chair assembly for rotational movement. The improved pawl and ratchet latching mechanism includes a spring-biased pawl assembly supported for pivotable movement from the stationary base assembly and a toothed ratchet sector fixed to a portion of the rockable chair frame. The spring-biased pawl assembly includes a pawl member and spring means for normally biasing the pawl member towards the ratchet sector for continuously exerting a controlled engagement force on the pawl member. A first end of a rigid release link is attached to the pawl member and a second end of the rigid release link is pivotally coupled to a swivel link which is journally supported for free rotation on the drive rod. A trip link is fixed for rotation on the drive rod and cooperates with the swivel link for positioning the pawl member with respect to the ratchet sector. As the drive rod is rotated in one direction, the trip link engages and rotates the swivel link such that the release link "pulls" the pawl member against the biasing of the spring means for disengaging the pawl member from the teeth of the ratchet sector. When the drive rod is rotated in an opposite direction, the trip link disengages the swivel link and allows it to rotate such that the biasing force of the spring means "pushes" the pawl member into engagement with the teeth of the ratchet sector. The spring means exerts a controlled biasing force on the pawl member for maintaining locked engagement with the ratchet sector. The trip link remains disengaged from the swivel link upon further rotation of the drive rod in the second direction. Thus, the swivel link is allowed to freely rotate on the drive rod thereby inhibiting exertion of axial loading on the release link following locked engagement of the pawl member with the ratchet teeth. When the drive rod is rotated back in the first direction, the trip link again engages the swivel link "pulling" the release link away from the pawl member causing it to disengage from the ratchet sector.

Additional objects, advantages and features of the present invention will become apparent to one skilled in the art from the following description and appended claims, taken in conjunction with the accompanying drawings.

DESCRIPTION OF THE DRAWINGS

FIG. 3 illustrates the rocking chair of FIG. 1 with the leg rest assembly in an "extended" position and the pawl and ratchet latching mechanism in a "locked" position;

FIG. 4 is a view, similar to FIG. 3, showing the rocking chair locked in a rearwardly "tilted" position with the pawl and ratchet latching mechanism in another "locked" position;

FIG. 6 is a section view of the spring-biased pawl assembly shown in FIG. 5;

FIG. 7 is a detail view illustrating the preferred connection between the release link and the swivel link;

FIG. 7A is a detail view illustrating an alternate connection between the release link and the swivel link; and FIG. 8 is a detail view of the blank prior to forming the pawl member of the present invention.

DETAILED DESCRIPTION OF THE PREFERRED EMBODIMENTS

Figure 1:
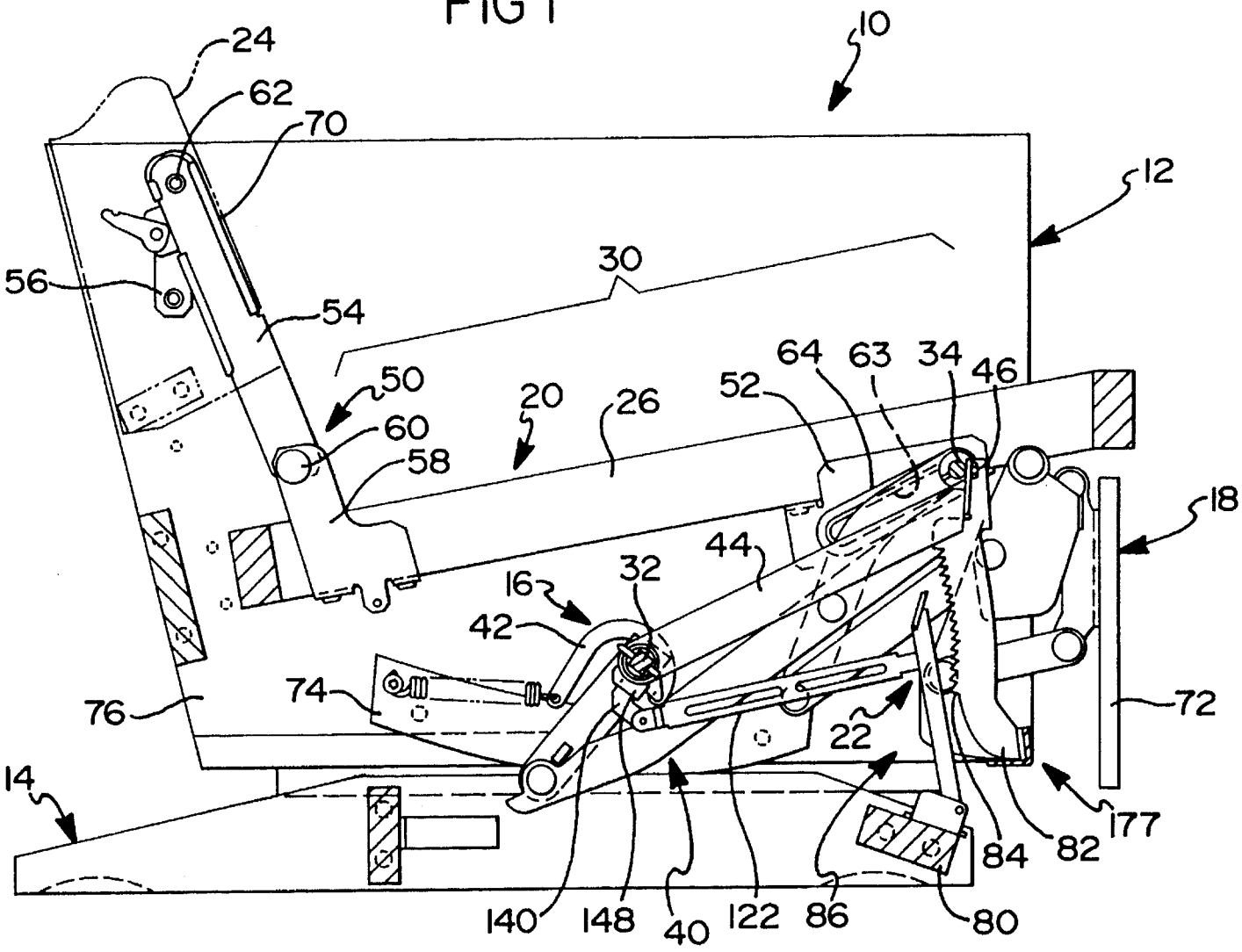
FIG. 1 is a side elevational view of an exemplary rocking chair having an extensible leg rest assembly and an improved pawl and ratchet latching mechanism constructed in accordance with a preferred embodiment of the present invention.

With particular reference to FIG. 1 of the drawings, an exemplary rocking chair is shown. More particularly, the exemplary rocking chair is a combination recliner and platform rocker, hereinafter referred to reclining/rocking chair 10. In general, reclining/rocking chair 10 includes a rigid chair frame 12, a base assembly 14, a manually-operated drive mechanism 16, an extensible leg rest assembly 18 and a "reclinable" seat assembly 20. In addition, an improved pawl and ratchet latching mechanism 22 is shown which is constructed in accordance with a preferred embodiment of the present invention. However, it should be understood that reclining/rocking chair 10 is exemplary in nature and is merely intended to illustrate the type of rocking chair to which improved pawl and ratchet latching mechanism 22 can be operably associated. For purposes of clarity, reclining/rocking chair 10 is shown with its upholstery, padding, springs, etc. removed to better illustrate the interdependency of the various components and mechanical linkages.

Combination reclining/rocking chair 10 is shown in FIG. 1 as having seat assembly 20 in a fully "upright" position and leg rest assembly 18 in its normally retracted or "stowed" position for permitting the seat occupant to enjoy conventional seating. Seat assembly 20 includes a seat back 24 which can be "reclined" relative to a seat member 26 independent of whether leg rest assembly 18 is positioned in the "stowed" position or the "extended" position. Such "reclining" movement of seat assembly 20 and protraction of leg rest assembly 18 to the "extended" position are shown in FIGS. 3 and 4. Reclining movement of seat assembly 20 is accomplished upon the seat occupant deliberately applying pressure to seat back 24 such that a seat swing linkage 30 causes seat member 26 to move forwardly and upwardly for maintaining seating comfort while the included angle increases therebetween. Reclining/rocking chair 10 may be easily returned to its "upright" position upon deliberate application of rearward pressure to seat assembly 20 or, more simply, if the seat occupant leans forward to remove pressure from seat back.

Figure 2:
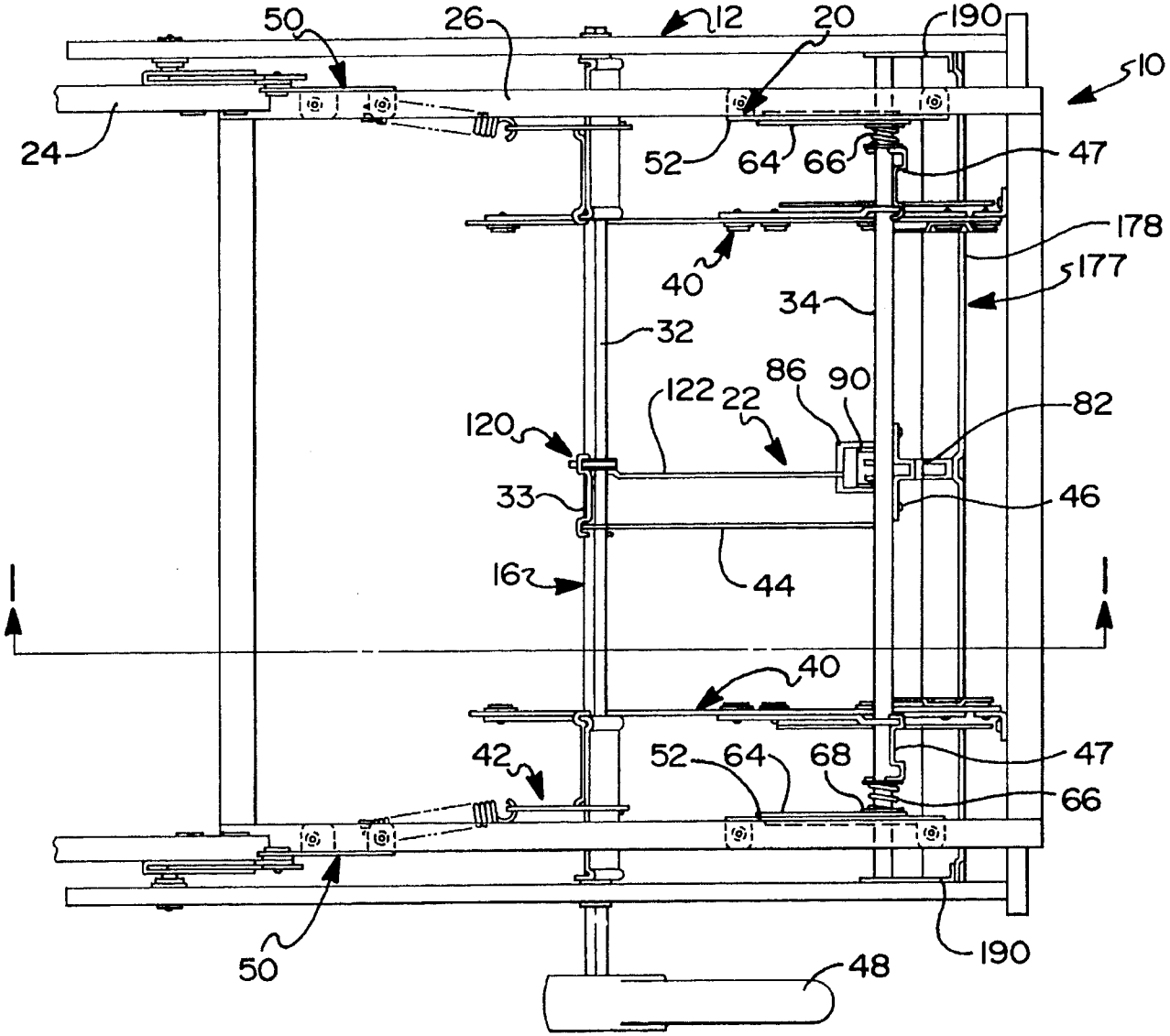
FIG. 2 is a partial plan view of the rocking chair of FIG. 1.
Figures 5, 5A:
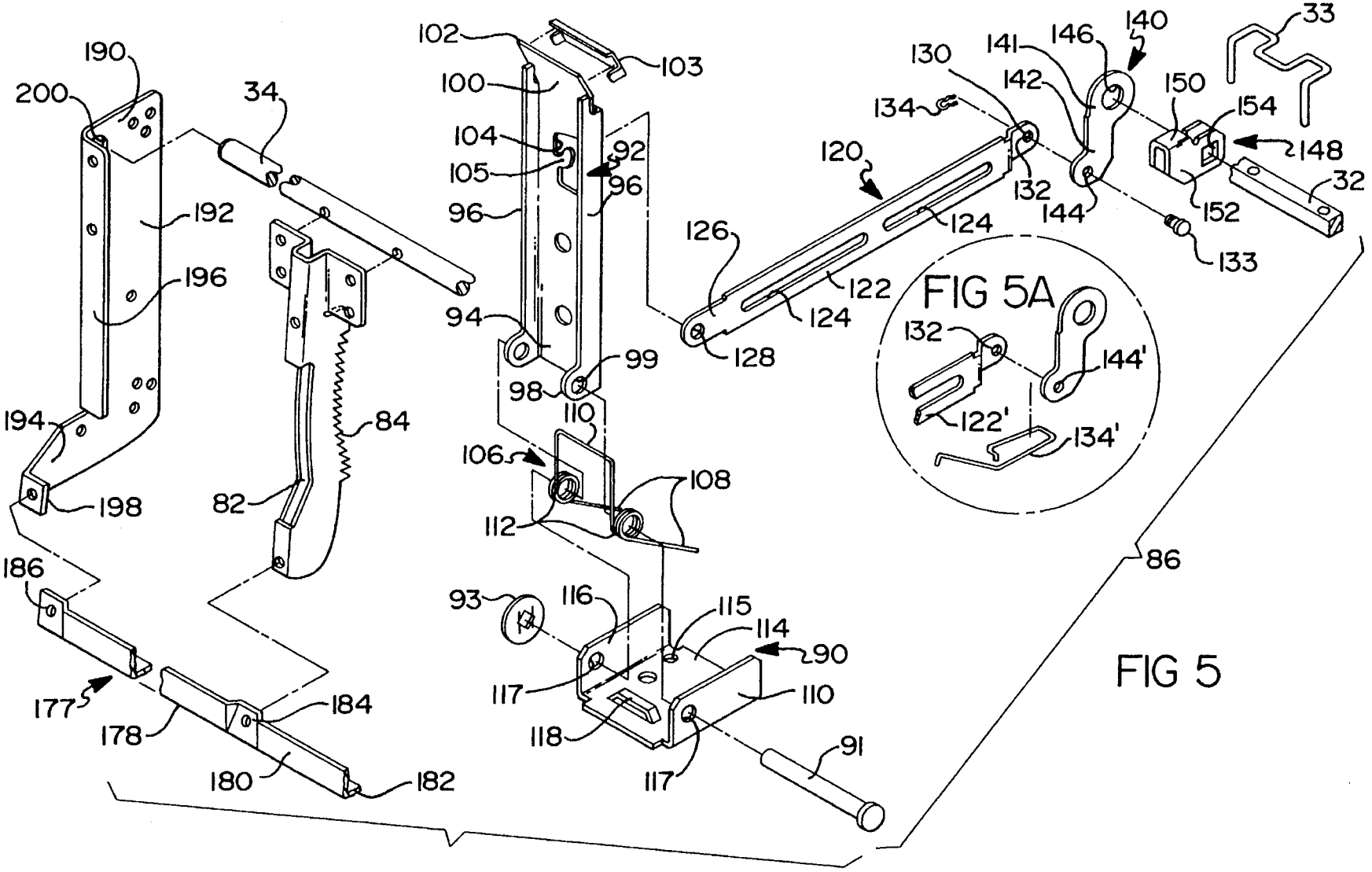
FIG. 5 is an exploded perspective view of the pawl and ratchet latching mechanism shown in FIGS. 1 through 4.
FIG. 5A is a detail view illustrating an alternate embodiment of the connector between the release link and the swivel link.

As best seen from FIGS. 1, 2, and 5 manually-operated drive mechanism 16 of reclining/rocking chair 10 is integrated into and operably suspended from chair frame 12. As will be described in greater detail hereinafter, drive mechanism 16 includes a drive rod 32 and a front support shaft 34, both of which are spatially oriented to be precisely located and "suspended" from chair frame 12. In a preferred embodiment of the present invention a multipiece front rail assembly 177 suspends front support shaft 34 and forms rigid box-like chair frame 12. Front rail assembly 177 includes lower cross member 178 and a pair of (i.e. left and right hand) end members 190 extending upwardly from opposite lateral ends thereof. Lower cross member 178 is generally L-shaped in cross section having vertical flange 180 and horizontal flange 182. Recess 184 is formed in the middle of lower cross member for receiving ratchet sector 82 by locally bending vertical flange 180 rearward and slightly off vertical. Recess 186, similar to recess 184, is formed at each end of lower cross member 178 for receiving end member 190.

End member 190 is generally L-shaped in plan view having a vertical leg 192 and a horizontal leg 194 that extends forwardly. A series of holes are formed in vertical leg 192 for securing front rail member 177 to chair frame 12. Slot 200 is also formed near the top of vertical leg 192 for receiving front support shaft 34. Transverse flange 196 extends from the front edge of vertical leg 192 towards ratchet sector 82 and is adapted to secure front support shaft 34 to end member 190. A second transverse flange 198 extends from the front edge of horizontal leg 194 towards ratchet sector 82 and is adapted to secure end member 190 to lower cross member 178. The orientation of ratchet sector 82 and recess 184, as well as transverse flange 198 and recess 186 facilitates the alignment and assembly of front rail assembly 177. A preferred method of assembling reclining/rocking chair 10 using preassembled modular frame components is thoroughly disclosed in U.S. Pat. No. 5,222,286, issued Jun. 29, 1993; U.S. Pat. No. 5,288,126, issued Feb. 22, 1994; and U.S. Pat. No. 5,301,413, issued Apr. 12, 1994; and U.S. application Ser. No. 08/100,916, filed Aug. 9, 1993, which are commonly owned by the Assignee of the present invention and the disclosures of which are expressly incorporated by reference herein.

With continued reference to FIGS. 1 and 2, drive mechanism 18 is shown to operably support leg rest assembly 18 thereon. More specifically, leg rest assembly 18 includes left and right pantograph linkages 40 and at least one spring-assisted over-center toggle linkage 42 which are operably associated with drive rod 32 and front support shaft 34 for permitting the seat occupant to selectively actuate leg rest assembly 18. A rigid cross-brace 44 is secured between drive rod 32 and support shaft 34 for providing structural rigidity within drive mechanism 16. Furthermore, cross-brace 44 is fixed to support shaft 34 via a threaded fastener 46 to inhibit rotation of support shaft 34 upon rotation of drive rod 32. In the preferred embodiment, drive rod 32 is an elongated square shaft having an actuation lever or handle 48 which is typically provided adjacent an upholstered exterior portion of chair frame 12 and that can be easily reached by a person seated in chair 10 for convenient actuation thereof.

As noted, seat member 26 is supported for movement relative to chair frame 12 by seat swing linkage means 30 for causing seat member 26 to move substantially horizontally and slightly up or down, depending on whether seat member 26 moves forwardly (i.e., during "reclining" movement) or rearwardly (i.e., on return to the "upright" position). Seat swing linkage means 30 are shown as left and right hand rear swing linkages 50 and left and right hand front slide brackets 52. Each rear swing linkage 50 includes an elongated swing link 54, a support bracket 56 and a seat bracket 58. The lower end of each rear swing link 54 is pivoted about a pivot point 60 to an upstanding post section of seat bracket 58. Seat bracket 58 has a horizontal flange portion that is securely fixed (such as by wood screws) to an underside surface of a seat member 26. As such, loading on the rear of seat member 26 passes from seat brackets 58 into rear swing links 54 as tension loading which is transferred by way of upper pivots 62 through support brackets 56 and into chair frame 12. Rear swing links 54 are elongated to provide increased leverage for balanced reclining action. Thus, the rear of seat member 26 moves much like a controlled pendulum on and below upper pivots 62. While the above description relates to a specific configuration for rear swing linkage 50, other rear swing linkage assemblies may be utilized without deviating from the scope of the present invention. For example, U.S. Pat. No. 5,184,871 entitled "Detachable Chair Back" which is commonly owned by the Assignee of the present invention discloses a rear swing linkage assembly which may be readily incorporated into the present invention.

Seat swing linkage means 30 also includes a pair of (i.e., left and right) front slide brackets 52 which are operable to guide and limit fore and aft movement of seat member 26. More particularly, front support shaft 34 extends through elongated guide slots 63 formed in left and right slide brackets 52 which have horizontal flanges securely fixed (such as by wood screws) to an underside surface of the front end of seat member 26. As will be appreciated, the angularity and length of guide slots 63 defines the range of fore and aft movement of seat member 26 relative to chair frame 12 upon the seat occupant applying a force to move seat assembly 20 between the "upright" and "reclined" positions. In addition, means are also provided for generating a predetermined amount of frictional drag upon movement of seat member 26 with respect to support shaft 34. In the particular embodiment shown, a nylon insert 64 is fixedly retained within guide slots 63. In addition, compression springs 66 are provided which concentrically surround opposite ends of support shaft 34 for biasing disk-like washers 68 into frictional engagement with nylon inserts 64. Nylon inserts 64 work in conjunction with compression springs 66 for controlling the friction resistance to movement of the front end of seat assembly 20 with respect to support shaft 34 while concomitantly acting to effectively dampen noise. Left and right spacer clips 47 are provided for preloading compression springs 66 and for positively locating and retaining pantograph leg rest linkages 40 on support shaft 34.

Seat back 24 is removably mounted on an upper portion of rear swing links 54 by means of slide brackets 70 secured at suitable locations on seat back 24. In general, slide brackets 70 are channel-shaped to provide an interior track that slidably receives rear swing links 54 therein. When slide brackets 70 are mounted on rear swing links 54, seat back 24 is, in effect, an extension of rear swing links 54 above pivot points 62. As such, seat back 24 can be pivoted about pivots 62 for acting as a lever arm for causing relatively easy angularly movement of rear swing links 54 and fore and aft movement of seat member 26.

Leg rest assembly 18 is shown to include a frame board 72 supported and moved by identical left and right hand pantograph linkages 40. Pantograph linkages 40 may be similar in function and structure to that shown in FIG. 3 of U.S. Pat. No. 3,096,121, assigned to the common assignee of the present invention, with the exception that pantograph linkages 40 are operably suspended from support shaft 34. Alternatively, pantograph linkage 40 may be similar in function and structure to that described in U.S. patent application Ser. No. 08/319,671 entitled "Dual Leg Rest Assembly" filed on Oct. 12, 1994 and commonly owned by the Assignee of the present invention. The disclosure of the above-identified patent and application are expressly incorporated by reference herein. The "extensible" action takes place simultaneously with both the left hand and right hand pantograph linkages 40 when there is sufficient angular rotation of drive rod 32 via rotation of actuation handle 48. In this manner, frame board 72 is movable between a normally "stowed" position when pantograph linkages 40 are retracted and its "extended" position when pantograph linkages 40 are protracted. As is known, leg rest assembly 18 may be returned to its "stowed" position upon the seat occupant applying a rearwardly directed force on frame board 72 or upon rotation of actuation handle 48 in the opposite direction.

To provide means for permitting chair frame 12 to rock relative to stationary base assembly 14, contoured rocker blocks 74 are secured to inner surfaces of chair frame side panels 76. Rocker blocks 74 are positioned to engage an upper surface of base assembly 14 in a "rockable" relation therewith. Preferably, rocker blocks 74 are interconnected to base assembly 14 by a double coil spring "rocker" device (not shown) similar to that disclosed in U.S. Pat. No. 5,171,000 issued on Dec. 15, 1992, commonly owned by the assignee of the present invention, the disclosure of which is expressly incorporated by reference herein. As will be appreciated, the rocker spring device is operable to permit balanced rocking movement of chair frame 12 with respect to fixed base assembly 14 without causing seat assembly 20 to recline inadvertently.

As an additional comfort feature, latching means 22 are provided for releasably retaining chair frame 12 in any one of a plurality of rearwardly "tilted" sequential positions upon angular rotation of drive rod 32 via rotation of actuation handle 48. As such, latching means 22 is operable to inhibit forward rocking movement of chair frame 12 following initial rearward movement of chair frame 12 to a desired "tilted" position. Latching means 22 of the present invention is directed to pawl and ratchet latching mechanism which is controllably actuated in response to angular movement of drive rod 32.

Pawl and ratchet latching mechanism 22 is an improvement over conventional latching arrangements and is specifically designed to provide increased service life and a reduction in the "ratcheting" noise generated upon actuation. Furthermore, pawl and ratchet latching mechanism 22 is designed to facilitate manufacture, assembly and service by utilizing a pawl member which can be stamped from a single blank in one operation and easily installed.

In general, pawl and ratchet latching mechanism 22 is operably arranged between front rail member 177 of chair frame 12 and forward cross-rail 80 of base assembly 14 for providing a plurality of sequentially lockable rearwardly "tilted" position. Pawl member 92 is pivotally connected to forward cross rail 80 by pawl bracket 90 and adapted to engage ratchet sector 82. Release member 120 operably interconnects pawl member 92 with actuation assembly 140 to enable the seat occupant to selectively operate pawl assembly 86 by rotating handle 48.

Pawl and ratchet latching mechanism 22 includes arcuate ratchet sector 82 secured at its lower portion to lower cross member segment 178 and at its upper portion to support shaft 34. A plurality of teeth 84 are formed on the arcuate surface of ratchet sector 82. The contour of teeth 84 are such that the points of teeth 84 are not sharp but rather have a slightly rounded point so that tip 102 or cap 103 does not gall teeth 84 when pawl member 92 is disengaged. Additionally, teeth 84 are varyingly sized in accordance with the spacial relationship of tip 102 or cap 103 relative to each tooth 84 such that pawl member 92 can fully engage tooth 84. This profile and configuration of teeth 84 reduces the noise as pawl member 92 cams over teeth 84 when chair 10 is tilted in a rearward direction. The rounded contour and spacing of teeth 84 further facilitates the disengagement of pawl member 92 from teeth 84 when chair 10 is returned to its free rocking state.

Pawl assembly 86 is supported on a pawl bracket 90 for pivotable movement about hinge pin 91. Pawl bracket 90 is secured to forward cross-rail 80 of base assembly 14. Pawl assembly 86 is pivotably movable with respect to sector teeth 84 between a disengaged ("released") position (as shown in FIG. 1) for permitting normal "rocking" action of chair 10, and an engaged ("locked") position (as shown in FIGS. 3 and 4) for positioning chair frame 12 in a rearward "tilted" orientation while inhibiting any subsequent forward "rocking" movement of chair frame 12. As best seen in FIGS. 5 and 6, pawl assembly 86 includes U-shaped pawl member 92 having web 94 and a pair of outwardly extending flanges 96. An upper portion 100 of pawl member web 94 is bent towards ratchet sector 82 to form upper chisel shaped locking tip 102 for engaging ratchet sector teeth 84. Optionally, spring steel cap 103 may be installed on locking tip 102 to reduce wear of the pawl surface upon locking tip 102 "ratcheting" over sector teeth 84 in response to rearward "tilting" movement of chair frame 12. Hinge portion 98, having aperture 99, is formed in flange portion 96 of pawl member 92. Aperture 99 is adapted to receive hinge pin 91 for pivotally connecting pawl member 92 to pawl bracket 90. Slot 104 is formed in web 94 of pawl member 92 and defines tab 105 having an upwardly extending portion for interconnecting release member 120 with pawl member 92.

Pawl member 92 of the present invention is particularly well suited for manufacturing in a single stamping operation. Referring now to FIG. 8, pawl member 92 is shown in its unfinished state. In a single stamping the profile of web 94, flanges 96, hinge portion 98 and upper portion 100 can be cut from a single piece of flat stock steel and bent to form the finished pawl member 92. Thus, this design reduces manufacturing time and cost by forming pawl member 92 in a single stamping operation.

Pawl bracket 90 includes base portion 114 and a pair of vertically extending flanges 116, each having apertures 117 for receiving hinge pin 91. Apertures 115 are provided in base portion 114 for attaching the bracket to forward cross-rail 80. Speed nut washer 93 is used for retaining pawl member 92 and hinge pin 91 between vertical flanges 116 of pawl bracket 90. Pawl bracket 90 further includes stop member 118 formed therein for engaging pawl member 92 to limit the counter-clockwise rotation of pawl member 92 (as shown in FIG. 6) towards its "released" position. Stop member 118 is preferably formed by lancing base portion 114 and bending the material from the aperture area outwardly into a partially circular strip 118 spaced outwardly from the base portion 114 as shown in FIG. 5.

Spring biasing member 106 is provided for normally biasing pawl member 92 in a direction toward ratchet sector 82 or, more simply, toward the "locked" position. In a preferred construction, the spring biasing member 106 is a dual torsion spring having a pair of laterally spaced legs 108, the free ends of which are maintained in contact with base surface 114 of pawl bracket 90. Transversely extending arm 110 interconnects laterally spaced legs 108 and is arranged to engage a rear surface of pawl member 92 in relatively close proximity to its pivot axis about hinge pin 91. The proximity of arm 110 to hinge point 91 is advantageous in that the biasing force of dual torsion spring 106 is applied to pawl member at a point displaced from locking tip 102 for further reducing noise generated upon locking tip 102 "ratcheting" over sector teeth 84.

Dual torsion spring 106 also includes an aligned set of loops 112 formed in legs 108 and which are arranged to concentrically surround hinge pin 91 between flange portion 96 of pawl member 92 and flange portion 116 of pawl bracket 90. Dual torsion spring 106 is designed such that arm 110 exerts a forwardly directed biasing force on pawl member 92 for maintaining locked engagement of pawl locking tip 102 with sector teeth 84 when pawl member is in the "locked" position. As will be appreciated, the particular number of loops 112 formed on legs 108 is selected to provide desired biasing force on pawl member 92.

Pawl and ratchet latching mechanism 22 further includes release member 120 which operably interconnects pawl member 92 and actuation assembly 140 supported from drive rod 32. Release member 120 includes rigid release link 122 having a first end 126 releasably secured to tab 105 formed in pawl member 92. A second end 130 of release link 122 is releasably secured to swivel link 141 by pin 133 and spring clip 134. First end portion 126 of release link 122 has aperture 128 formed therethrough for receiving tab 105. The geometry of slot 104 and tab 105 is such that release link 122 is retained by the upwardly extending portion of tab 105. The second end 130 is offset from the remaining portion of release link 122 for attachment to swivel link 141 while maintaining alignment of release link 122 with pawl member 92. Second end 130 includes aperture 132 for receiving pin 133 which is releasably retained therein by spring clip 134 for pivotally connecting release link 122 to swivel link 141. Release link 122 is sufficiently stiff such that the loading imparted thereon during operation of pawl and ratchet latching mechanism 22 does not appreciably bend or deform it. Release link 122 further includes slots 124 to reduce the weight of release link 122 without substantially sacrificing stiffness thereof.

Alternatively, as shown in FIG. 5A and FIG. 7A, a spring clip 134' can be used for attaching release link 122. Spring clip 134' includes traverse portion 135' extending through aperture 132 of release link 122 and aperture 144 in swivel link 141. A pair of laterally extending legs 136', 138' extend from traverse portion 135' towards release link 122. Lateral leg 136' has a U-shaped grasp 137' formed on its end for engaging lateral leg 138' below release link 122. Laterally extending leg 138' has U-shape end 139' formed thereon for engaging the upper surface of release link 122.

Referring again to FIGS. 5 and 7, swivel link 141 includes leg portion 142 having aperture 144 formed therein for receiving pin 133 and spring clip 134 as heretofore described. The opposite end of swivel link 141 includes oversized aperture 146 for receiving square drive rod 32. In this manner, swivel link 141 is supported on drive rod 32 but allowed to rotate independent from the rotation of drive rod 32. Optionally, a nylon bushing may be interdisposed between drive rod 32 and swivel link 141 to facilitate free rotation thereabout. Trip link 148 is generally U-shaped and includes transversely extending tab 150 arranged to extend over a front edge of leg portion 142 of swivel link 141 and a pair of laterally extending flanges 152 which capture swivel link 141. A square aperture 154 is formed in flanges 152 for engaging drive rod 32 such that rotation of drive rod 32 rotates trip link 148. Trip link 148 is captured by spring clip 33 to position trip link 148 along the axial direction of drive rod 32. As best seen in FIG. 1, when leg rest assembly 18 is in its "stowed" position, flange 150 acts on the front edge of swivel link leg portion 142 for retaining swivel link 141 and, in turn, pawl member 86 in its rearwardly "release" position in opposition to the biasing of dual torsion spring 106.

Release assembly 120 is installed by first positioning release link 122 into slot 104 such that tab 105 is inserted into aperture 128, then release link 122 is guided to engage tab 105. Release link 122 is rotated to align aperture 132 with swivel link aperture 144. Pin 133 is inserted through apertures 132 and 144. Spring clip 134 captures the end of pin 133 to releasably retain pin 133 in aperture 132, 144. In an alternate embodiment, spring clip 134' is inserted through apertures 132' and 144'. End portion 137' is positioned to grasp lateral leg 138' while end portion 139' is flexed to capture the upper surface of release link 122. In this manner, release link 122 may be easily installed and serviced with only one fastener and does not require the use of any tools.

Operation of pawl and ratchet latching mechanism 22 will now be described. As illustrated in FIG. 1, rocking reclining chair 10 is positioned with its seat back in an upright position and the leg rest in a retracted or "stowed" position. In arriving at that position from the leg rest "protracted" position, tab 150 of trip link 148 acts on the front edge of swivel link leg portion 142 as the actuation handle 48, and therefore, drive rod 32 is rotated to rotate swivel link 141 in the clockwise direction. This, in turn, "pulls" release link 122 rearward, causing pawl member 92 to rotate about hinge pin 91 into its rearwardly "release" position, in opposition to the biasing of dual torsion spring 106. In this way, chair frame 20 is free to rock on rocker block 74 relative to base 14. A seat occupant may manually manipulate actuation lever 48 to activate pawl and ratchet latching mechanism 22 for inhibiting relative rocking motion of rocker/recliner chair 10. In this manner, actuation lever 48 and drive rod 32 are rotated in a counter-clockwise direction (as shown in FIGS. 3 and 4). Rotation of drive rod 32 concomitantly rotates trip link 148 such that flange 150 disengages swivel link 141 to allow it to freely rotate on drive rod 32. In this manner, release link 120 is pulled forwardly in response to the biasing force generated by torsional spring 106 acting on pawl assembly 86. Once locking tip 102 engages teeth 84 of ratchet sector 82, there no longer exists an axial load on release member 120 due to swivel link 141 being journally supported on drive rod 32 and the engagement force of pawl member 86 is solely controlled by dual torsion spring 106.

Following rotation of actuation handle 48, rearward "tilting" of chair frame 12 causes locking tip 102 of pawl member 86 to sequentially "ratchet" over sector teeth 84 until the desired degree of tilt has been reached. In this manner, the rocking components of chair 10 are effectively "locked out" for preventing chair frame 12 from returning to its forward "nontilted" position. However, a seat occupant may further "tilt" the chair by rocking backwards. As shown in FIG. 4, the geometry of ratchet sector 82 is such that pawl member 92 will ratchet over teeth 84 to allow further tilting.

When it is desired to return chair frame 12 to its "upright" position from a rearwardly "tilted" position, actuation handle 48 is rotated in the clockwise direction (as shown in FIGS. 3 and 4) causing corresponding rotation of trip link 148. Upon sufficient rotation of drive rod 32, flange 150 engages swivel link 141, thereby causing swivel link 141 to rotate concurrently with trip link 148. In this manner, release member 122 is "pulled" rearwardly in response to continued rotation of trip link 148 and swivel link 141, thereby pivoting pawl member 86 in a direction towards its "release" position. Tip 102 is withdrawn from teeth 84 of ratchet sector 82. Further retraction of pawl member 86 from ratchet sector 82 is limited when the lower portion of pawl 92 engages stop member 118 formed in base portion 114 of pawl bracket 90. This limits the stress exerted in opposing dual torsion spring 106, thereby permitting the use of spring members having a lower spring constant. With pawl member 86 in the "release" position, chair frame 12 is once again capable of unrestricted rocking action on base assembly 14 in a well known manner.

The operation of the present invention described above does not refer to the coordinated movement of leg rest assembly 18 in conjunction with the operation of pawl and ratchet latching mechanism 22 of the present invention. However, the features of the present invention are readily adaptable with a rocker/recliner chair incorporating leg rest assembly 18. In this configuration, pawl assembly 86 is operably positionable in the "release" position when leg rest assembly 18 is in the retracted or "stowed" position as shown in FIG. 1. Rotation of drive rod 32 concurrently operates to rotate trip link 148 and extend leg rest assembly 18 towards its fully extended position. Thus, in this mode of operation, the relative rocking motion of chair frame 12 on base assembly 14 is disabled when leg rest assembly 18 is extended into a used position.

As an additional benefit, release link 120 is designed to facilitate easy assembly or disassembly. This feature permits relatively simple field service without requiring excessive disassembling or manipulation of the components. As best seen in FIG. 5, first and second ends 126, 130, respectively, have apertures 128, 132 for quickly positioning and securing release link member 120 to pawl member 92 and swivel link 141. Tab 105 of pawl member 102 hooks onto release link 120 through aperture 128 and provides a durable, freely rotation joint, without the use of additional fasteners such as rivets or screws. Pin 133 and spring clip 134 are designed to quickly couple second end 130 with swivel link 141 without the need for tools. Thus, the present invention eliminates unnecessary weight and provides a quieted operating locking mechanism at a lower cost.

The foregoing discussion discloses and describes exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A rocking chair comprising:

a base;

a chair frame supported for rocking movement on said base;

a drive mechanism including a drive rod suspended from said chair frame for rotational movement in a first and second direction;

actuation means for permitting a seat occupant to selectively actuate said drive mechanism;

a ratchet sector secured to said chair frame and having ratchet teeth formed thereon;

a pawl member pivotally coupled to said base for rotational movement between a first position lockingly engaging said ratchet teeth wherein said chair frame is releasably locked in a rearwardly tilted position, and a second position released from said ratchet teeth for permitting unrestricted rocking movement of said chair frame;

spring means for normally biasing said pawl member toward said first position, said spring means adapted to exert an engagement force on said pawl member for maintaining locked engagement with said ratchet teeth when said pawl member is in said first position;

a release assembly including a swivel link supported on said drive rod for free rotation thereabout, a rigid release link having a first end coupled to said pawl member and a second end disposed adjacent to said swivel link, and means for pivotally connecting said second end to said swivel link; and a trip link fixed for rotation on said drive rod and operable to engage said swivel link in response to rotation of said drive rod in said first direction for causing limited rotation of said swivel link such that said release assembly pulls said pawl member toward said second position in opposition to the biasing of said spring means, said trip link further operable to disengage said swivel link in response to rotation of said drive rod in said second direction such that said spring means urges said pawl member into locking engagement with said ratchet teeth.

2. The rocking chair of claim 1 wherein said pawl member further comprises a hook formed thereon for engaging said release link to couple said release assembly to said pawl member.

3. The rocking chair of claim 2 wherein said pawl member is generally U-shaped in cross section having a web portion and a pair of laterally extending flanges, said web portion having a chisel-tip formed therein for engaging said ratchet sector, and each of said flanges having a hole therethrough for pivotally coupling said pawl member to said base.

4. The rocking chair of claim 3 further comprising a pawl bracket having a bottom portion secured to said base and a pair of laterally spaced flanges for receiving said pawl member therebetween, said flanges having an aperture therethrough for receiving a pin to pivotally couple said pawl member to said pawl bracket.

5. The rocking chair of claim 4 wherein said pawl bracket further comprises stop means for limiting pivotable movement of said pawl member toward said second position.

6. The rocking chair of claim 1 wherein said trip link captures and transversely locates said swivel link on said drive rod.

7. The rocking chair of claim 6 wherein said trip link comprises a pair of laterally spaced flanges disposed on opposite sides of said swivel link and a transverse flange interconnecting said laterally spaced flanges for engaging said swivel link.

8. A latching mechanism for releasably locking a chair frame of a rocking chair in a rearwardly tilted position relative to a stationary base assembly in response to rotation a drive mechanism between a first and second direction, said latching mechanism comprising:

a ratchet sector fixed to said chair frame and having ratchet teeth formed thereon;

a pawl member pivotally coupled to said chair frame for rotational movement between a first position lockingly engaging said ratchet teeth wherein said chair frame is releasably locked in a rearwardly tilted position, and a second position released from said ratchet teeth for permitting unrestricted rocking movement of said chair frame;

spring means for normally biasing said pawl member toward said first position, said spring means adapted to exert an engagement force on said pawl member for maintaining locked engagement with said ratchet teeth when said pawl member is in said first position;

a release assembly including a first member supported on said drive mechanism for free rotation thereabout, a rigid release link having a first end coupled to said pawl member and a second end disposed adjacent to said first member, and means for pivotally coupling said second end to said first member, said release link adapted to pull said pawl member into said second position when said drive rod is actuated in said first direction, and said release link further adapted to release said pawl member into said first position when said drive rod is actuated in said second direction;

a second member fixed for rotation on said drive rod and operable to engage said first member in response to rotation of said drive rod in said first direction for causing limited rotation of said first member such that said release assembly pulls said pawl member toward said second position in opposition to the biasing of said spring means, said second member further operable to disengage said first member in response to rotation of said drive rod in said second direction such that said spring means urges said pawl member into locking engagement with said ratchet teeth.

9. The latching mechanism of claim 8 wherein said pawl member further comprises a hook formed thereon for engaging said release link to couple said release assembly to said pawl member.

10. The latching mechanism of claim 9 wherein said pawl member is generally U-shaped in cross section having a web portion and a pair of laterally extending flanges, said web portion having a chisel-tip formed therein for engaging said ratchet sector, and each of said flanges having a hole therethrough for pivotally coupling said pawl member to said base.

11. The latching mechanism of claim 10 further comprising a pawl bracket having a bottom portion secured to said base and a pair of laterally spaced flanges for receiving said pawl member therebetween, said flanges having an aperture therethrough for receiving a pin to pivotally couple said pawl member to said pawl bracket.

12. The rocking chair of claim 11 wherein said pawl bracket further comprises stop means for limiting pivotable movement of said pawl member toward said second position.

13. The rocking chair of claim 8 wherein said second member captures and transversely locates said first member on said drive rod.

14. The rocking chair of claim 13 wherein said second member comprises a pair of laterally spaced flanges disposed on opposite sides of said first member and a transverse flange interconnecting said laterally spaced flanges for engaging said first member.

* * * * *